United States Patent [19]

Moraw

[11] 4,438,321

[45] Mar. 20, 1984

[54] FIXING DEVICE FOR COPIER

[75] Inventor: Roland Moraw, Wiesbaden, Fed. Rep. of Germany

[73] Assignee: Hoechst Aktiengesellschaft, Frankfurt am Main, Fed. Rep. of Germany

[21] Appl. No.: 354,550

[22] Filed: Mar. 4, 1982

[30] Foreign Application Priority Data

Mar. 11, 1981 [DE] Fed. Rep. of Germany ..... 3109164

[51] Int. Cl.[3] ..... G03G 15/20; H05B 3/02

[52] U.S. Cl. ..... 219/216; 355/3 FU; 219/388; 219/543; 338/306

[58] Field of Search ..... 219/216, 388, 469, 543, 219/470, 471; 100/93 P, 93 RP; 355/3 FU; 346/76 R; 338/306, 307, 308, 311, 334

[56] References Cited

U.S. PATENT DOCUMENTS

| | | | |
|---|---|---|---|
| 3,243,579 | 3/1966 | Sussin | 219/216 |
| 3,517,164 | 6/1970 | Huggins | 219/216 |
| 3,649,810 | 3/1972 | Tsuboi | 219/216 |
| 3,968,347 | 7/1976 | Isoard | 219/469 |
| 4,034,189 | 7/1977 | Sakamaki et al. | 219/216 |
| 4,109,135 | 8/1978 | Minden | 219/216 |

FOREIGN PATENT DOCUMENTS

| | | | |
|---|---|---|---|
| 2014107 | 4/1970 | France | 219/216 |

OTHER PUBLICATIONS

European Search Report.

*Primary Examiner*—B. A. Reynolds
*Assistant Examiner*—Teresa J. Walberg
*Attorney, Agent, or Firm*—Schwartz, Jeffery, Schwaab, Mack, Blumenthal & Koch

[57] ABSTRACT

Disclosed is a fixing device for an electrophotographic copier, comprising a heater plate for fixing the toner image of a recording support passing over the surface of said heater plate. The heater plate comprises a multiple-layered laminate including a contact layer for contacting the recording support; a heating layer; and at least first and second heat-insulating layers, one provided on either side of the heating layer and being selected so as to provide for a lower heat capacity of the heater plate during the heating-up operation and until it reaches the working temperature than the heat capacity during continuous operation. The device comprises a heat accumulating layer, and the first insulating layer is adjacent to the contact layer and the second insulating layer is in contact with the heat accumulating layer. The heat transfer coefficient of the first insulating layer is higher than the heat transfer coefficient of the second insulating layer.

9 Claims, 2 Drawing Figures

FIXING DEVICE FOR COPIER

BACKGROUND OF THE INVENTION

The present invention relates to a fixing device for an electrophotographic copier, comprising a heater plate having at least two layers and a surface over which a recording support carrying the toner image to be fixed is transported.

In electrophotographic copiers, a photoconductor layer is electrostatically charged and then exposed imagewise. The latent charge image which is thus produced on the photoconductor layer is developed into a visible image with the aid of a dry toner or a liquid toner. A liquid toner is substantially composed of a dispersing fluid comprising aliphatic hydrocarbons, wherein the toner is dispersed in the form of charged pigments. The developed, moist toner image is pressed against a recording support, for example, paper and is thereby transferred from the photoconductor layer to the recording support. The photoconductor layer is then cleaned for the next copying cycle. The moist toner image on the support, which is not yet fast to wiping, is fixed by the application of heat. A reliable technique which is used in many copiers consists in guiding the moist recording support over a heated plate, the support contacting the plate with its reverse side while being transported over the plate.

Such heater plates, which have a planar or curved shape, comprise a metal body with electrical heating elements embedded therein. In a known embodiment, the heater plate is constructed of cast aluminum and has the dimensions $2.5\times85\times290$ mm, with two embedded heating rods each having 400 Watts heating power. The temperature is adjusted to about 200° C. by means of a thermo-feeler, in a two-position control system, i.e., by switching on and off.

When conventional electrophotographic copiers are switched on after a prolonged downtime, the photoconductor is usually first cleaned from any dried-on toner residue by rinsing with toner liquid during a warming-up period of about 25 seconds. In this warming-up period, heating up of the heater plate to its working temperature commences. At the end of the warming-up period of 25 seconds, however, a heater plate of the above-described kind has a temperature of only about 65° C., at an ambient temperature of about 22° C. The working temperature of about 200° C. is reached only after about 80 seconds. As a result, the first copies which are produced immediately after the warming-up period are often not fast to wiping after fixing. Particularly, in copiers operating at higher copying speeds of about 30 copies per minute and more, which have a collator for the copies connected to their output side, blurred copies are frequently found.

After a short downtime of the apparatus of up to some minutes, the heater plate which cools down slowly due to its high heat capacity, is still warm so that the warming-up period can be reduced to a few seconds and the waiting time for each copy can be kept short.

If the apparatus is additionally heated during the warming-up period, at a power which is far higher than the operating power, the normal admissible load limits of the electrical installations are often exceeded and there is consequently a risk of the apparatus breaking down.

SUMMARY OF THE INVENTION

It is an object of the present invention to provide an improved fixing device for a copier.

It is a particular object of the invention to provide a fixing device of the above-described kind in which the period required for heating up to working temperature relative to the warming-up period is shortened, without thereby increasing the heating power requirement of the heater plate.

In accomplishing the foregoing objects, there has been provided in accordance with the present invention a fixing device for an electrophotographic copier, comprising a heater plate for fixing the toner image of a recording support passing over the surface of said heater plate. The heater plate comprises a multiple-layered laminate including a contact layer for contacting the recording support; a heating layer; and at least first and second heat-insulating layers, one provided on either side of the heating layer, these heat-insulating layers being selected so as to provide for a lower heat capacity of the heater plate during the heating-up operation and until it reaches the working temperature than the heat capacity during continuous operation. Preferably, the device further comprises a heat accumulating layer, and the first insulating layer is adjacent to the contact layer and the second insulating layer is in contact with the heat accumulating layer. The heat transfer coefficient of the first insulating layer is higher than the heat transfer coefficient of the second insulating layer. In one embodiment, the first and second insulating layers comprise the same material and the first insulating layer has a smaller thickness than the second insulating layer.

Further objects, features and advantages of the present invention will become apparent from the detailed description of preferred embodiments which follows, when considered together with the attached figures of drawings.

BRIEF DESCRIPTION OF THE DRAWINGS

The invention is explained in further detail with reference to the accompanying drawings. In the drawings.

DETAILED DESCRIPTION OF PREFERRED EMBODIMENTS

Figure 1:
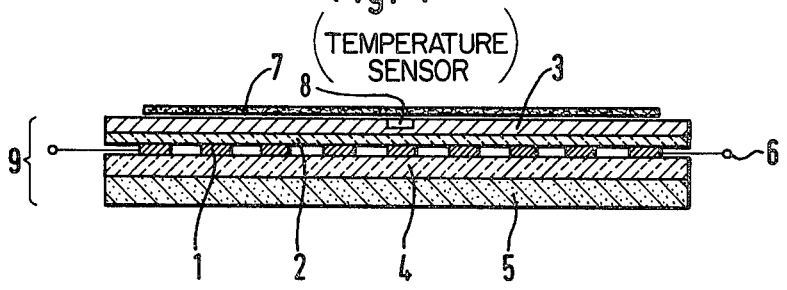
FIG. 1 is a cross-sectional view of a heater plate according to the invention, which is built up of several layers.

In the fixing device according to the present invention, a heating layer is sandwiched between further layers which are provided on either side thereof, and the dimensions and material compositions of which are chosen so that the heat capacity of the heater plate at the beginning of the heating-up operation and up to the point of reaching its working temperature is lower than its heat capacity in continuous operation.

The invention has the advantage that the heater plate heats up quickly and cools down slowly so that, from the start, fixed copies are obtained which are fast to wiping. Furthermore, in the case of short downtimes of the copier, the fixed copies are fast to wiping almost without any waiting time after switching on the copier. This results from the fact that, upon switching on the copier, the effective heat capacity is at first low, but is subsequently high during continuous operation when the working temperature has been reached.

Referring now to the drawings, a heating layer 1 comprising an electrically heatable layer which is made up of a thin metal sheet arranged as a continuous area or is in the form of strips or of resistance wires arranged in a pleated or helical form, constitutes the center part of a heater plate 9. In an embodiment which includes, for example, six sheet-metal strips of 280 mm length extending in the longitudinal direction of the heater plate 9, which has a width of 85 mm, the resistance between connecting contacts 6 is approximately 15 ohms. At a supply voltage of 110 Volts, the installed capacity is 807 Watts.

The heating layer 1 is sandwiched between two insulating layers 2 and 4 which have different coefficients of heat transfer. A contact layer 3 over which a recording support 7 is transported is adjacent to the insulating layer 2, while the other insulating layer 4 contacts an accumulating or storage layer 5. The insulating layer 2 has a higher heat transfer coefficient than the insulating layer 4.

The thickness of the insulating layer 2 is smaller than that of the insulating layer 4, if the two layers are constructed of the same material. The net result in either case is that more insulation is placed on the bottom of heater plate 9 than on the top thereof.

The heat capacity of the contact layer 3 is chosen in such a way that it is lower than or equal to the heat capacity of the accumulating or storage layer 5. If the same material is used for the two layers, the accumulating or storage layer 5 is, therefore, generally thicker than the contact layer 3.

Suitable temperature-resistant insulating materials for the two layers 2 and 4 comprise mica or heat-stable films, for example, polyimide films. Also ceramic paper, which is a felt composed of mineral-ceramic fibers, has proved to be a good insulating material. A rapid heat transfer from the heating layer 1 to the contact layer 3 is obtained by means of a thin insulating layer 2, for example, comprising a 0.4 mm thick ceramic paper. In order to test the influence of the thickness of the insulating layer 2 on the heat transfer, a 0.8 mm thick ceramic paper is also used. The contact layer 3 must be mechanically stable with respect to the recording supports and/or copies 7 which are transported over it and slidingly contact its surface. By means of a good thermal conductivity, the contact layer 3 must furthermore ensure an effective heat transfer from the heater plate 9 to the copies. A perfectly suitable material for the contact layer 3 is, for example, a copper sheet, against which the passing copies are urged, for example, by means of driven or idler rollers, which are not shown in the drawing. In a preferred embodiment, the contact layer 3 comprises a 1 mm thick copper sheet. A copper sheet which is considerably thinner, for example, having a thickness below 0.5 mm is less suitable, since cooling caused by the copies sliding over the sheet would then result in excessive temperature variations of 20° C. and even higher.

Appropriately, a temperature sensor 8 which controls the heating voltage is embedded in the contact layer 3. The material for the insulating layer 4 is chosen among the temperature-resistant insulating materials which are also used for the layer 2.

In one embodiment, the insulating layer 4 comprises a 4 mm thick ceramic paper so that the heat transfer from the heating layer 1 to the accumulating or storage layer 5 is considerably slower than the heat transfer to the contact layer 3, through the comparatively thin insulating layer 2 which has a thickness of 0.4 mm or 0.8 mm. The accumulating or storage layer 5 serves as a heat accumulator. In principle, it comprises a temperature-resistant material, for example, a ceramic. Metal is also preferably used because of its higher break resistance. The thicker the accumulating layer 5 is chosen, the higher is the heat capacity of the entire heater plate 9 and the slower cooling proceeds after the termination of the copying cycle.

To allow a comparison between the actions of a heater plate 9 according to the invention and a conventional heater plate, the thickness of the accumulating or storage layer 5 was chosen inter alia with a view to obtaining similar values for the heat capacities of the heater plates to be compared. The accumulating or storage layer 5 was made of a 1 mm thick copper sheet. A heat-insulating layer was additionally applied to the uncovered surface of the accumulating or storage layer 5.

Figure 2:
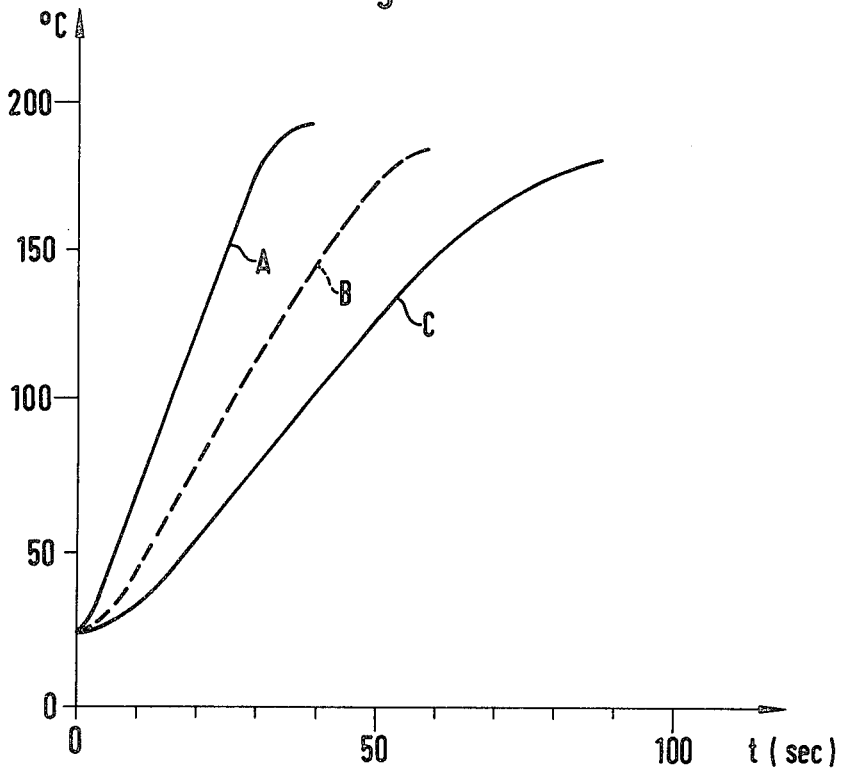
FIG. 2 is a plot of the temperature rise as a function of heating time, as determined on the surface of several heater plates.

In FIG. 2, the temperatures in Centigrade measured on the contact layers 3 of three differently constructed heater plates are indicated as a function of heating time in seconds. The curves A and B show the temperature rise of the heater plate 9 according to the invention, having an insulating layer 2 of 0.4 mm thickness of ceramic paper and an insulating layer 2 of 0.8 mm thickness, respectively. Curve C represents the temperature rise of a conventional heater plate. A reduction of the effective heat capacity during heating up results in a faster temperature rise of the contact layer 3 (Curves A and B as compared to Curve C). The temporary reduction of the effective heat capacity is achieved by splitting up the heat given off by the heating layer 1 into a first heat flow directed toward the contact layer 3 and a second heat flow directed toward the accumulating or storage layer 5. In this splitting up of heat, the heat flow into the contact layer is at least equal to, but preferably is greater than the heat flow into the accumulating or storage layer 5. If the contact layer 3 and the accumulating or storage layer 5 are of a similar construction and if insulating materials of the same kind are used, this is simply determined by the thicknesses of the insulating layers 2 and 4. The thinner the layers are, the higher are the coefficients of heat transfer. An increasing ratio of the coefficients of heat transfer of insulating layer 2 with respect to insulating layer 4 leads to a faster temperature rise upon heating up, as can be seen from a comparison between curves A and B. The ratio of the coefficients of heat transfer is about 10:1 for curve A, and about 5:1 for curve B. The ratio of the slopes of curves A:B:C is 2.6:1.6:1. In the case of a thinner contact layer 3, for example, comprising a 0.5 mm thick copper sheet, the temperature rise in relation to that of curve C is almost 4:1.

The above-described actions relate to the switching-on operation which is terminated when the preset temperature, for example, 200° C., has been reached. Upon reaching the predetermined temperature, the heating voltage is interrupted until the temperature drop exceeds the permissible range of temperature variation. These switching-on and switching-off operations alternate during the copying cycle. In the process, the temperature of the accumulating or storage layer 5 is slowly and steadily raised by the temperature flow through the insulating layer 4. This aids in maintaining the temperature of the fixing device at a relatively high level during short periods of shut-down.

The invention has been described with reference to a fixing device in an electrophotographic copier. It is, however, naturally also possible to use the heater plate according to the invention in recording apparatuses in which, for example, charge images are produced with the aid of recording electrodes.

What is claimed is:

1. A fixing device for an electrophotographic copier, comprising a heater plate for fixing the toner image of a recording support passing over the surface of said heater plate, wherein said heater plate comprises a multiple-layered laminate including:

a contact layer for contacting the recording support;

a heating layer;

at least first and second heat-insulating layers, one provided on either side of said heating layer, said heat-insulating layers being selected so as to provide for a lower heat capacity of said heater plate during the heating-up operation and until it reaches the working temperature than the heat capacity during continuous operation; and a heat-accumulating layer, wherein said first insulating layer is adjacent to said contact layer and said second insulating layer is in contact with said heat-accumulating layer.

2. A fixing device as defined in claim 1, wherein the heat transfer coefficient of said first insulating layer is higher than the heat transfer coefficient of said second insulating layer.

3. A fixing device as defined in claim 2, wherein said first and second insulating layers comprise the same material and wherein said first insulating layer has a smaller thickness than said second insulating layer.

4. A fixing device as defined in claim 2 or 3, wherein the ratio of the heat transfer coefficients of said first insulating layer and said second insulating layer ranges between about 10:1 and 5:1.

5. A fixing device as defined in claim 1, wherein the material of said insulating layer is selected from the group comprising mica, temperature-stable synthetic films and ceramic paper composed of mineral-ceramic fibers.

6. A fixing device as defined in claim 1, wherein the heat capacity of said contact layer is lower than or equal to the heat capacity of said accumulating layer.

7. A fixing device as defined in claim 6, wherein said accumulating layer comprises a ceramic.

8. A fixing device as defined in claim 6, wherein said contact layer and said accumulating layer are comprised of the same material and wherein the thickness of said accumulating layer is greater than the thickness of said contacting layer.

9. A fixing device as defined in claim 8, wherein said accumulating layer and said conducting layer comprise a metal having a good heat conductivity.

* * * * *